US006911910B2

(12) United States Patent
Sansone et al.

(10) Patent No.: US 6,911,910 B2
(45) Date of Patent: Jun. 28, 2005

(54) METHOD FOR DETECTING AND REDIRECTING MISDIRECTED MAIL

(75) Inventors: Ronald P. Sansone, Weston, CT (US); Leon A. Pintsov, West Hartford, CT (US); Robert A. Cordery, Danbury, CT (US); Marc Morelli, Stamford, CT (US); Arthur Parkos, Southbury, CT (US); Ronald Reichman, Trumbull, CT (US); Claude Zeller, Monroe, CT (US)

(73) Assignee: Pitney Bowes Inc., Stamford, CT (US)

( * ) Notice: Subject to any disclaimer, the term of this patent is extended or adjusted under 35 U.S.C. 154(b) by 153 days.

(21) Appl. No.: 10/238,510

(22) Filed: Sep. 10, 2002

(65) Prior Publication Data

US 2004/0049315 A1 Mar. 11, 2004

(51) Int. Cl.[7] ..... G08B 13/14

(52) U.S. Cl. ..... 340/572.1; 340/571; 340/539; 340/572.8; 700/225; 705/408

(58) Field of Search ..... 340/572.1, 505, 340/539, 571, 572.8, 572.7; 700/225; 705/408

(56) References Cited

U.S. PATENT DOCUMENTS

| | | | | |
|---|---|---|---|---|
| 5,043,908 A | | 8/1991 | Manduley et al. | 364/476 |
| 5,971,587 A | | 10/1999 | Kato et al. | |
| 5,978,781 A | | 11/1999 | Sansone | 705/408 |
| 6,188,996 B1 | * | 2/2001 | Sansone | 705/408 |
| 6,208,910 B1 | * | 3/2001 | Michael et al. | 700/225 |
| 6,211,781 B1 | | 4/2001 | McDonald | 340/505 |
| 6,249,227 B1 | | 6/2001 | Brady et al. | 340/572.1 |
| 6,259,369 B1 | * | 7/2001 | Monico | 340/572.8 |
| 6,260,029 B1 | | 7/2001 | Critelli | |
| 6,480,108 B2 | * | 11/2002 | McDonald | 340/505 |
| 6,496,806 B1 | | 12/2002 | Horwitz et al. | |
| 6,669,089 B2 | | 12/2003 | Cybulski et al. | |
| 6,738,689 B2 | * | 5/2004 | Sansone | 700/223 |
| 2001/0032190 A1 | | 10/2001 | Ediger et al. | |
| 2001/0040513 A1 | | 11/2001 | McDonald | |
| 2002/0029153 A1 | | 3/2002 | Lee et al. | |

* cited by examiner

*Primary Examiner*—Jeffery Hofsass
*Assistant Examiner*—Daniel Previl
(74) *Attorney, Agent, or Firm*—Ronald Reichman; Angelo N. Chaclas

(57) ABSTRACT

Radio frequency identification tags are placed on mail contained in trays or tubs to locate and reroute mail that is misdirected, i.e., being routed to the incorrect destination. The method involves the carrier reading the identifying information contained in the radio frequency identification tags on each mail piece while each mail piece is in the trays or tubs and removing one or more mail pieces in the tray or tub that are to be routed differently than that routing information contained on the outside of the trays or tubs.

15 Claims, 3 Drawing Sheets

METHOD FOR DETECTING AND REDIRECTING MISDIRECTED MAIL

CROSS REFERENCE TO RELATED APPLICATIONS

Reference is made to commonly assigned patent applications Ser. No. 10/238,874 filed herewith entitled "Method For Detecting And Redirecting Major Mailer's Special Service Mail" in the name of Ronald P. Sansone; Ser. No. 10/238,405 filed herewith entitled "Method For Processing And Delivering Registered Mail" in the name of Leon A. Pintsov; and Ser. No. 10/238,864 filed herewith entitled "Method For Maintaining The Integrity Of A Mailing Using Radio Frequency Identification Tags" in the names of Leon S. Pintsov, Kenneth G. Miller, Kwan Cheung Wong and John H. Winkelman.

FIELD OF THE INVENTION

The invention relates generally to the field of mailing systems and, more particularly, to systems for locating mail.

BACKGROUND OF THE INVENTION

Governments have created Posts for collecting, sorting and distributing the mail. The Post typically charges mailers for delivering the mail. Mailers may pay the Post for its service by purchasing a stamp, i.e., a printed adhesive label, issued by the Post at specified prices that is affixed to all letters, parcels or other mail matter to show prepayment of postage. The placing of one or more stamps on a mail piece is a labor-intensive endeavor. Thus, only individuals, small or home offices, and small businesses, typically use stamps.

Businesses with large mail volumes often use alternate means of evidencing postage. One such means of payment accepted by the Post is mail that is metered by a postage meter. A postage meter is a mechanical or electromechanical device that maintains, through mechanical or "electronic registers" or "postal security devices," an account of all postage printed, and the remaining balance of prepaid postage; and prints postage postmarks (indicia) or provides postage postmarks (indicia) information to a printer that are accepted by the postal service as evidence of the prepayment of postage.

The United States Postal Service "Post") currently handles large volumes of such mail, i.e., first class mail, standard A mail, standard B mail, etc., hereinafter referred to as "normal mail". However, when it comes to special service mail, i.e., priority mail, certified mail, registered mail, etc., the Post uses gummed service stickers and forms to indicate evidence of payment and to process the special service mail. The use of gummed service stickers and completion of forms by hand is time consuming and error prone and hence raises the expense for receiving these services. For example, some special service mail may become mixed with normal mail potentially causing failure for the Post to provide the purchased service. To better ensure that the service is rendered, some services, e.g., certified mail, require the mailer to physically deliver the mail piece to the Post.

Mail of both of the abovementioned types may be posted at the Post, deposited in a Post mail drop, a street mail drop or any other Post receptacle. Special services mail should be expeditiously handled by the Post and should only be transported with other special service mail. Unfortunately, since special service mail and normal mail may use the same induction points, special service mail may be co-mingled with regular mail as mentioned earlier. Thus, the Post has to extract special service mail from regular mail. If the special service mail is not properly identified, the special service mail will travel with regular mail and may be delivered with regular mail without the special service requested by the sender, that is, the party paying for the special service may not receive the special service.

A disadvantage of the prior art is that once a special service mail piece is accepted by the Post or other carrier and placed in a tray or bag, the Post or other carrier has limited means for determining the current location of the special service mail piece.

Another disadvantage of the prior art is that the carrier is not able to determine the location of misdirected mail until the mail is delivered to the delivery Post or delivery office. Rerouting the mail to the correct delivery Post or delivery office is time consuming and expensive.

SUMMARY OF THE INVENTION

This invention overcomes the disadvantages of the prior art by utilizing a system that enables special service mail to be detected automatically and separated from normal mail. The invention also enables carriers, e.g., United States Postal Service®, FedEx®, Emory®), Airborne®, DHL®, United Parcel Service®, etc., to determine the location of special service mail as it travels within their systems.

By the carrier knowing the location of the mail, the carrier is able to redirect misdirected mail. The foregoing saves the carrier time and money, since the carrier determines that the mail is misdirected earlier in the delivery cycle.

DETAILED DESCRIPTION OF THE PREFERRED EMBODIMENT

Figure 1:
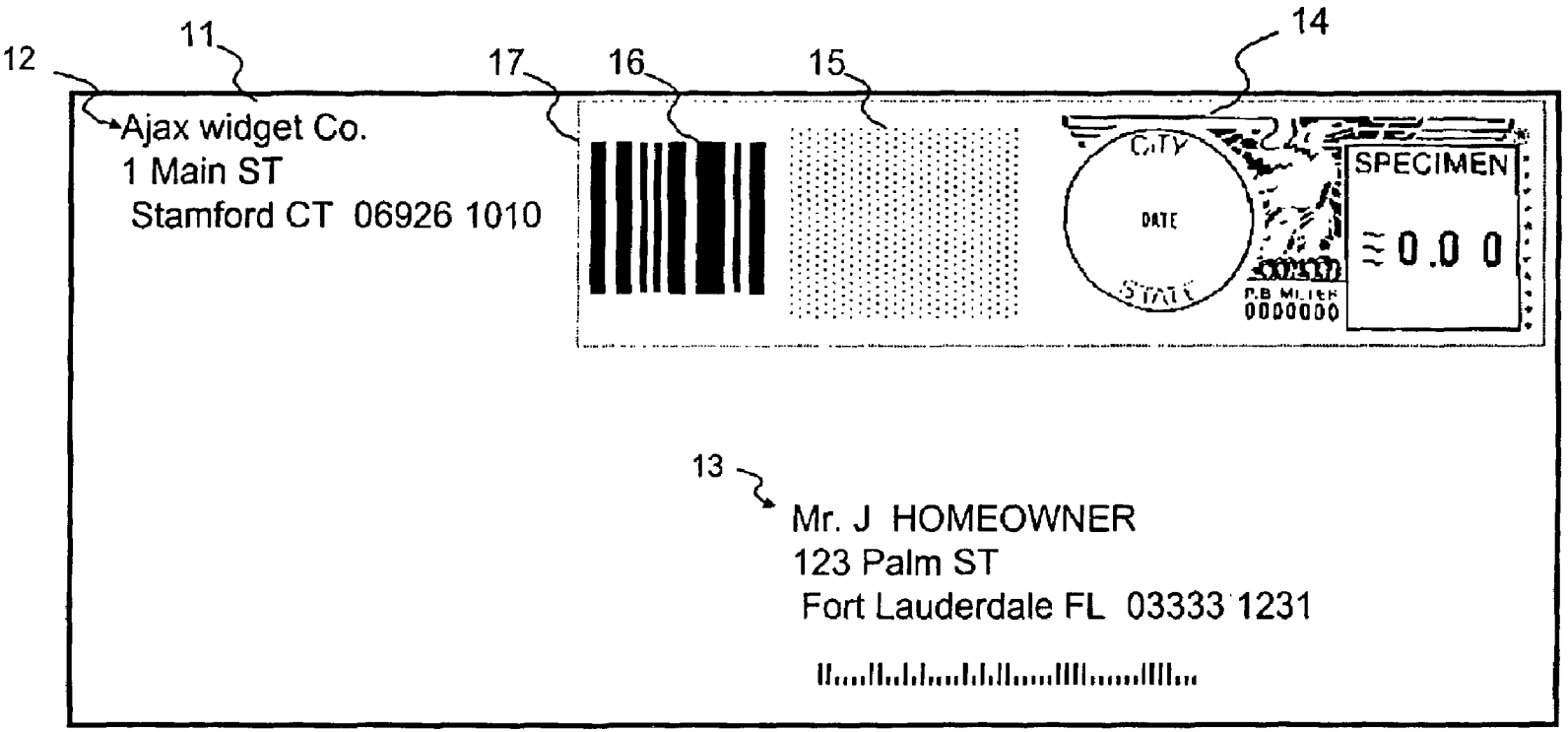
FIG. 1 is a drawing of a mail piece having a radio frequency identification tag.

Referring now to the drawings in detail and more particularly to FIG. 1, the reference character 11 represents a mail piece that has a sender address field 12, a recipient address field 13, a postal indicia 14, a radio frequency identification tag 15, and a bar code 16 that contains specified information. Radio frequency identification (RFID) tag 15 may be the Philips 4×6 RFID Smart Label manufactured by RAFEC USA of 999 Oakmont Plaza Drive, Suite 200, Westmont, Ill. 60559. The information contained in tag 15 is the sender address field 12, recipient address field 13, and type of special service to be performed by the carrier, i.e., priority mail, certified mail, registered mail, express mail, etc. The information contained in bar code 16 and the recipient's expected delivery time are also written into tag 15 by a radio frequency identification tag printer (not shown). The radio frequency identification tag printer may be the Zebra R140 printer manufactured by Zebra Technologies Corporation of 333 Corporate Woods Parkway, Vernon Hills, Ill. 60061. Indicia 14 and tag 15 may be placed on a paper tape 17 that is adhered to mail piece 11, or indicia 14 may be printed directly on mail piece 11, and tag 15 is affixed to mail piece 11.

Figure 2:
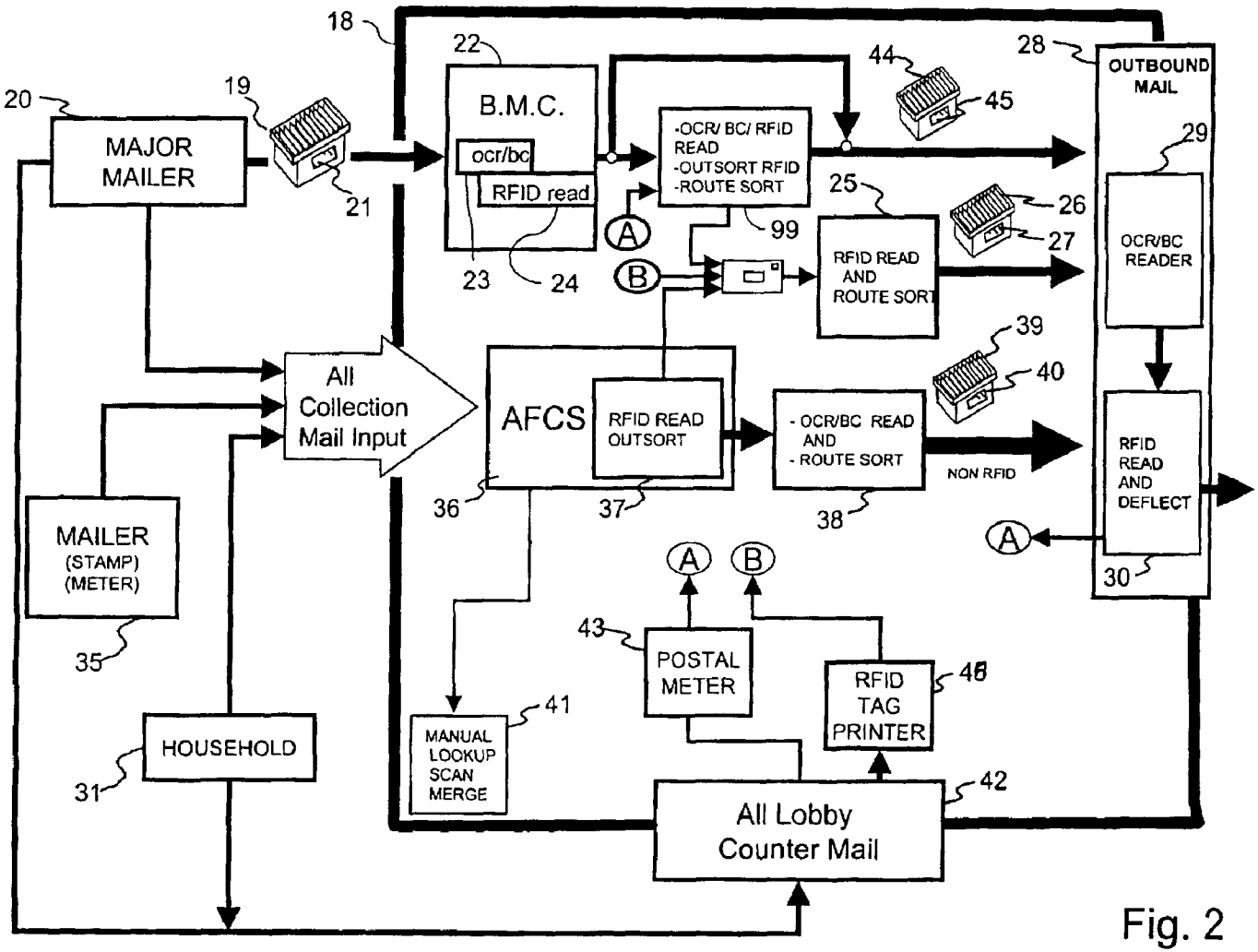
FIG. 2 is a drawing showing how mail is processed in the entry office of a carrier.

FIG. 2 is a drawing showing how mail is processed in the entry office 18 of a carrier. Letter mail that is deposited in tray 19 by major mailer 20 contains a bar code 21 on the outside of tray 19. Bar code 21 indicates the destination (postal code) of tray 19. Tray 19 is delivered to bulk mail center 22 of office 18. Optical character/bar code reader 23 reads the information contained in bar code 21, and radio frequency identification reader 24 reads the information contained in tag 15 (FIG. 1) of mail contained within the tray. Mail that contains a tag 15 will be placed in a tray 44 that has a bar code 45 for mail that is going to the same destination office as tray 44. Tray 44 will pass through outbound exit 28 of entry office 18 as the delivery process of tray 44 proceeds. Outbound exit 28 contains optical readers 29 that read bar code 45 and radio frequency identification readers 30 that read any tag 15 that may be present. If mail containing a tag 15 is detected in a tray 44, that mail is sent back to the input of RFID/Sorter 25, provided it is not going to the same destination office as tray 44.

Radio frequency identification (RFID) reader 24 may be the model SL EV900 reader manufactured by Philips Semiconductors of 1109 McKay Drive, San Jose, Calif. 95131. Some mail containing a tag 15 will go to RFID/Sorter 25 where the mail will be placed in a tray 26 that has a bar code 27 on the outside of tray 26. Bar code 27 indicates the destination office of tray 26. Only mail that has a tag 15 affixed thereto is contained in tray 26. Tray 26 contains mail with tags 15 affixed thereto that will pass through outbound exit 28 of entry office 18 as the delivery process of tray 26 proceeds. Outbound exit 28 contains optical readers 29 that read bar code 27 and radio frequency identification readers 30 that read tags 15. If mail containing a tag 15 does not go to the destination indicated by bar code 27, that mail is sent back to the input of reader 99 so that it may be placed in a special service mail tray that is going to the correct destination office.

Collection letter mail may be metered letter mail that is produced at a mailer site 35 that is able to place postal indicia 14 on mail 11 (FIG. 1) with a postage meter (not shown) and a tag 15 on the mail with a radio frequency identification label printer (not shown), or stamped mail or metered mail. Collection mail may also be mail that is received from a household 31. Collection letter mail is sent to advanced facer canceller (hereinafter "AFCS") 36. AFCS 36 contains a radio frequency identification reader 37 that reads tags 15.

AFCS 36 faces the letter mail and then AFCS 36 electronically identifies and separates prebarcoded mail, handwritten addresses and machine-imprinted address pieces for faster processing through automation. Letter mail that AFCS 36 determines is optical character readable is sent to OCR read and sort 38. Read and sort 38 reads the entire address on the mail sprays a bar code on the mail, if needed; and then sorts the mail. The mail is then placed in a tray 39 that has a bar code 40 on the outside of tray 39. Bar code 40 indicates the destination of tray 39 and other information about the contents of tray 39. Only mail that does not have a tag 15 affixed thereto should be contained in tray 39. Tray 39 will pass through outbound exit 28 of entry office 18 as the delivery process of tray 39 proceeds. Outbound exit 28 contains optical readers 29 that read bar code 40, and radio frequency identification readers 30 that read any tag 15 that may be present. If mail containing a tag 15 not for the destination office is detected in tray 39, that mail is sent back to the input of reader 99 so that it may be placed in a tray that is going to the correct destination office. Letter mail that AFCS 36 determines is not optical character readable is sent to manual look up scan and merge 41 where the mail is manually processed. Radio frequency identification reader 37 reads tags 15 and sends the mail containing a tag 15 to RFID/Sorter 25.

Mail that is produced at household 31 and other mail may be brought directly to the carrier at lobby counter 42. The mailer will pay the carrier the necessary amount to deliver the mail in accordance with the delivery service requested. Postage meter 43 and radio frequency identification printer 48 will print postal indicia on special service mail. Postage meter 43 will place postal indicia on normal mail, i.e., first class mail, standard A mail and standard B mail. Mail that just contains postal indicia will be sent to the input of optical character reader 99. RFID tag printer 48 will print a tag 15 (FIG. 1) on special service mail, i.e., priority mail, certified mail, registered mail, etc., and meter 43 will print a postal indicia 14 on special service mail. Printer 48 may be the Zebra model R140 manufactured by Zebra Technologies Corporation of 333 Corporate Woods Parkway Vernon Hills, Ill. 60061-3109. Special service mail will be sent to the input of RFID/Sorter 25.

Figure 3:
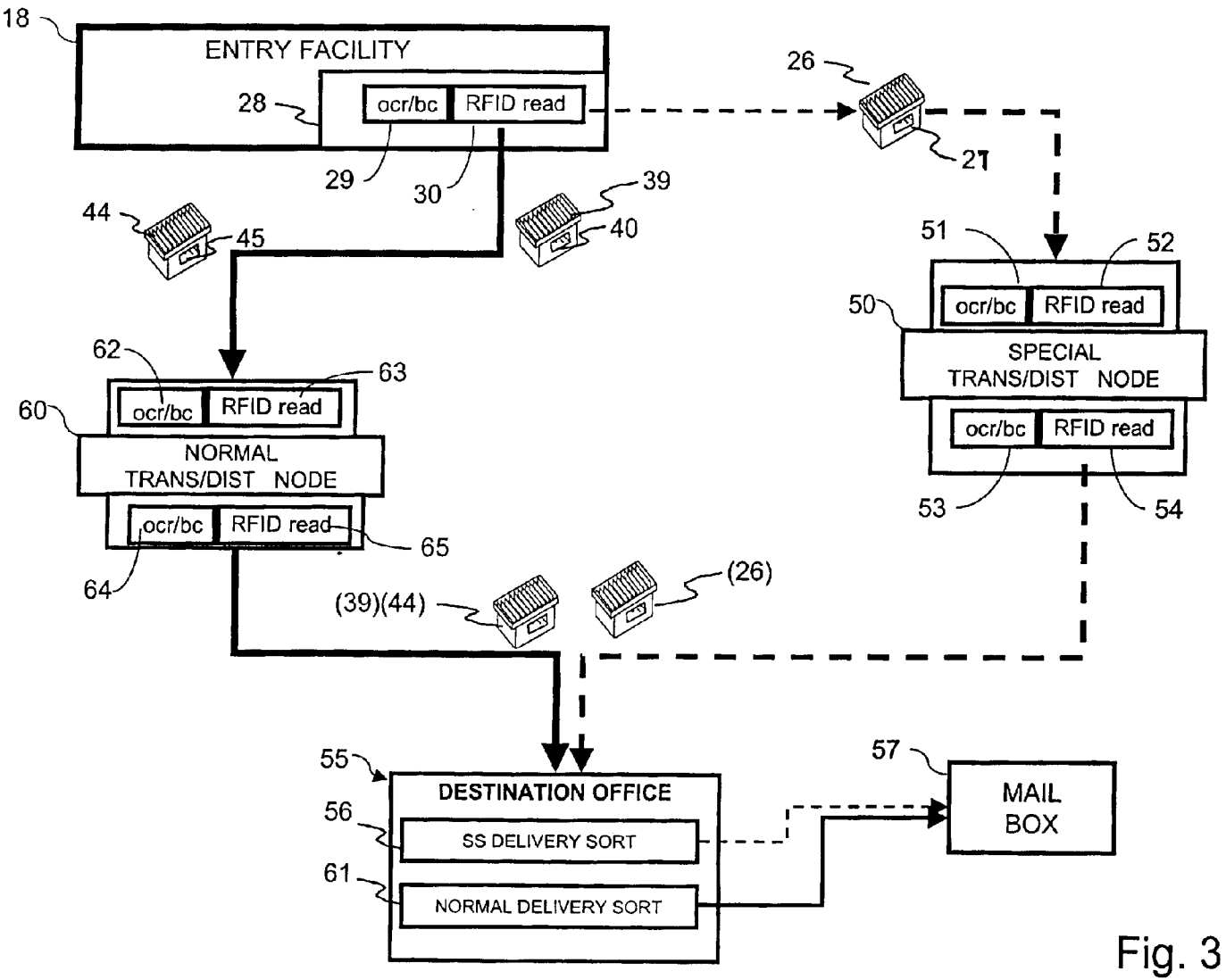
FIG. 3 is a drawing showing how mail is processed from the entry office of a carrier to the recipient.

FIG. 3 is a drawing showing how mail is processed from entry office 18 of a carrier to the recipient. At outbound mail exit 28, optical scanners 29 read the information contained in bar codes 27, 40 and 45 that are respectively affixed to trays 26, 39 and 44 and radio frequency identification readers 30 read any tag 15 that may be present in a tray or tub to which bar codes 27, 40 and 45 are affixed.

All mail in tray 26 that has a tag 15 and is going to the destination specified in bar code 27 will be sent to special transport distribution node 50. Optical scanner 51 and RFID scanner 52, respectively, will read barcode 27 that is affixed to tray 26 and tags 15 as they enter special distribution node 50, and optical scanner 53 and RFID scanner 54, respectively, will read code 27 and tags 15 as tray 26 exit distribution node 50. Tray 26 containing mail having tags 15 affixed thereto will be delivered to destination carrier office 55.

At this point, RFID Special Service sorter 56 will sort the mail contained in tray 26. Then, the mail will be delivered to the recipient by being deposited in mail box 57. The mail may also be delivered directly to the recipient or to a representative of the recipient based upon the special services requested by the sender.

Trays 39 and 44 will be delivered to standard transportation distribution node 60. Then trays 39 and 44 will be delivered to destination carrier office 55. Sorter 61 will sort the mail contained in trays 39 and 44. Then, the mail will be delivered to the recipient by being deposited in mail box 57. The mail may also be delivered directly to the recipient or to a representative of the recipient based upon the special services requested.

The above specification describes a new and improved method for detecting mail that is transported in trays or tubs. It is realized that the above description may indicate to those skilled in the art additional ways in which the principles of this invention may be used without departing from the spirit. Therefore, it is intended that this invention be limited only by the scope of the appended claims.

What is claimed is:

1. A method for detecting and redirecting mail that is transported in trays or tubs, said method comprises the steps of:

A. preparing a radio frequency identification tag that identifies a mail piece delivery address and the services to be performed by a carrier;

B. placing the radio frequency identification tag on mail pieces that will be transported in trays or tubs;

C. reading by the carrier the identifying information contained in the radio frequency identification tags on each mail piece while each mail piece is in the trays or tubs;

D. verifying that each mail piece in the tray or tub should be routed to the same destination office in the same manner; and E. removing one or more mail pieces in the tray or tub that are to be routed differently than that specified in step D.

2. The method claimed in claim 1, further including the step of:

placing information regarding the routing of trays or tubs on the outside of the trays or tubs.

3. The method claimed in claim 2, further including the step of:

reading the delivery information on the outside of the trays or tubs;

comparing the routing information on the outside of the trays or tubs with the routing information on each mail piece; and removing one or more mail pieces in the tray that are not routed in the manner specified by the routing information on the outside of the trays or tubs and the delivery information on each mail piece.

4. The method claimed in claim 3, further including the step of:

placing the removed mail pieces in a tray or tub that is going to be routed on or about the delivery address specified in the radio frequency identification tag.

5. The method claimed in claim 2, further including the step of:

reading the delivery information on the outside of the trays or tubs;

comparing the routing information on the outside of the trays or tubs with the routing and service information on each mail piece; and removing one or more mail pieces in the tray that are not routed in the manner specified by the routing information on the outside of the trays or tubs and the delivery and service information on each mail piece.

6. The method claimed in claim 3, further including the step of:

placing the removed mail pieces in a tray or tub that is going to receive the service specified in the radio frequency identification tag.

7. The method claimed in claim 1, further including the step of:

transporting the mail pieces in the trays or tubs to a destination carrier office.

8. The method claimed in claim 1, further including the step of:

placing the removed mail pieces in a tray or tub that is going to be transported to a common destination carrier office.

9. The method claimed in claim 1, further including the step of:

placing the removed mail pieces in a tray or tub that is going to have the same postal service.

10. The method claimed in claim 9, further including the step of:

placing the same postal service mail pieces in a tray or tub that is going to be transported to a common destination carrier office.

11. The method claimed in claim 1, further including the step of:

reading the information in the radio frequency identification tags while each mail piece is being transported in the trays or tubs.

12. The method claimed in claim 11, further including the step of:

reporting the location of each read radio frequency identification tag to the carrier.

13. The method claimed in claim 1, further including the step of:

sealing the tray with a cover to protect the mail pieces in the tray from the environment.

14. The method claimed in claim 13, further including the step of:

reading the information contained in the radio frequency identification tags while the mail pieces are contained in the sealed tray.

15. The method claimed in claim 14, further including the step of:

reporting the information read from the mail pieces in the sealed tray to the carrier.

* * * * *